US009353488B2

(12) United States Patent
Schneider

(10) Patent No.: US 9,353,488 B2
(45) Date of Patent: May 31, 2016

(54) GROUND COVERING FOR SPORTS AREAS, AND METHOD FOR PRODUCING IT

(71) Applicant: Sportek OHG, Olfen (DE)

(72) Inventor: Hans-Joachim Schneider, Olfen (DE)

(73) Assignee: Sportek OHG, Olfen (DE)

( * ) Notice: Subject to any disclaimer, the term of this patent is extended or adjusted under 35 U.S.C. 154(b) by 0 days.

(21) Appl. No.: 14/353,336

(22) PCT Filed: Nov. 9, 2012

(86) PCT No.: PCT/EP2012/072256

§ 371 (c)(1),
(2) Date: Apr. 22, 2014

(87) PCT Pub. No.: WO2013/068527

PCT Pub. Date: May 16, 2013

(65) Prior Publication Data

US 2014/0287844 A1 Sep. 25, 2014

(30) Foreign Application Priority Data

Nov. 10, 2011 (DE) ..... 10 2011 055 235

(51) Int. Cl.
*E01C 13/06* (2006.01)
*E01C 13/00* (2006.01)

(52) U.S. Cl.
CPC ..... *E01C 13/065* (2013.01)

(58) Field of Classification Search
CPC ..... E01C 13/06; E01C 7/30; E01C 7/35; E01C 19/12
USPC ..... 472/85–87, 90, 92, 94; 404/1, 17
See application file for complete search history.

(56) References Cited

U.S. PATENT DOCUMENTS

| | | | | |
|---|---|---|---|---|
| 4,606,963 | A * | 8/1986 | Farrell | 428/150 |
| 4,897,302 | A * | 1/1990 | Bull | 442/395 |
| 5,352,158 | A * | 10/1994 | Brodeur, Jr. | 472/92 |
| 6,786,674 | B1 | 9/2004 | Hanks | |
| 7,713,133 | B2 * | 5/2010 | Wolf | 472/91 |

FOREIGN PATENT DOCUMENTS

| | | |
|---|---|---|
| DE | 2258566 A1 | 6/1974 |
| DE | 27 43 533 | 4/1979 |
| DE | 2826206 A1 | 12/1979 |
| DE | 3231231 A1 | 3/1984 |
| DE | 3539204 A1 | 5/1987 |

(Continued)

OTHER PUBLICATIONS

International Search report dated Feb. 6, 2013.

*Primary Examiner* — Kien Nguyen
(74) *Attorney, Agent, or Firm* — Bachman & LaPointe, PC

(57) ABSTRACT

A ground covering for sports areas, in particular tennis courts. In order to provide a ground covering for sports areas and in particular for tennis courts which has not only the advantageous play properties of a sand court but also the care and maintenance properties of a hard court, there is provided at least one layer (4) having a first, mineral particle material (1) which is doubly crushed and a second particle material (3) and also a binder (2), wherein an average particle size of the second material (3) is less than an average particle size of the first material (1), and the second material (3) is arranged at least partially in depot zones (5) formed by the first material.

9 Claims, 2 Drawing Sheets

(56) References Cited

FOREIGN PATENT DOCUMENTS

| | | |
|---|---|---|
| DE | 201 00 678 | 8/2001 |
| EP | 0 165 895 | 12/1985 |
| EP | 0 358 209 | 3/1990 |
| EP | 0 392 129 | 10/1990 |
| EP | 1811086 | 7/2007 |
| EP | 1811086 A1 | 7/2007 |

* cited by examiner

GROUND COVERING FOR SPORTS AREAS, AND METHOD FOR PRODUCING IT

BACKGROUND OF THE INVENTION

The invention relates to a ground covering for sports areas and in particular for tennis courts and a method for producing a corresponding ground covering.

Coverings for sports areas and in particular also for tennis courts are known in the state of the art. Normally, ground coverings for tennis courts specifically are divided into two basic categories, namely hard courts on one hand and sand or respectively brick dust courts on the other hand, wherein the latter are also called "clay courts".

Hard courts have relatively good play properties, namely a consistent ball bounce and a high ball speed. Moreover, hard courts require little maintenance and no watering. Conventional hard courts are disadvantageous due to their relatively high construction costs, the high ball and shoe abrasion, a high ball bounce as well as a high stress on the ligaments, tendons and joints of the athletes or respectively players due to the blunt and hard surface.

In the contrast, the advantages of sand courts are low construction costs, a low ball speed, longer ball exchanges, good dampening properties as well as advantageous turning and sliding properties of the athletes or respectively players. The disadvantages of sand courts are the comparatively higher maintenance, only low freeze resistance, the need to be constantly watered as well as inconsistent ball bounce.

Due to the described advantages and disadvantages, it was already attempted in the state of the art to reproduce the play and slide behavior of a sand court tennis covering in the case of simultaneously improved maintenance properties.

Thus, e.g. EP 0 358 209 A2 discloses a tennis court covering with a first layer made of an elastic polymer material and a second layer made of hard sand reinforced with a binder. A non-reinforced brick dust layer is provided as the sliding layer.

However, this type of covering is problematic due to the permanent grating of the scattered sliding layer so that a high abrasion and thus wear of the covering results. Besides the need for frequent maintenance due to the wear, the water permeability through the sliding material crushed in this manner also decreases greatly even after a short period of play. The covering becomes hereby mainly water-impermeable, which greatly impairs controlled start and stop movements by the athletes or respectively players as well as the sliding properties of the covering specifically needed in tennis. Thus, in the case of this type of covering, the play properties are considerably degraded even after a short period of play.

SUMMARY OF THE INVENTION

Based on the aforementioned problems, the object is to provide a ground covering for sports areas and in particular for tennis courts, which has on one hand the advantageous play properties of a sand court but improved care and maintenance properties.

The object is solved through a ground covering for sports areas and in particular for tennis courts as disclosed herein as well as a corresponding method for producing a ground covering as disclosed herein. The disclosure also describes preferred embodiments of the invention.

According to the invention, the ground covering has at least one layer with a first mineral particle material, a second particle material and a binder. An average particle size of the second particle material is less than an average particle size of the first particle material. The first particle material is bound with the binder. According to the invention, the first mineral particle material is crushed multiple times.

The ground covering according to the invention thus has at least one layer with two particle materials, which have different average particle sizes. The first mineral particle material hereby forms an open porous frame due to the larger particle size, so that the second particle material is arranged at least partially in the gaps formed by the frame—hereinafter referred to as "depot zones."

In the context of the present invention, the term "particle material" means a (solid) substance that consists mainly of a plurality of individual particles or respectively grains and is also called particulate or respectively granulate medium.

According to the invention, the first particle material is bound by the binder, i.e. the individual particles of the first material adhere together in the layer of the covering and thus form a film-like composite. Naturally, it is hereby neither required that each grain of the first particle material is correspondingly bound nor that it is a completely "rigid" composite. As explained below, it is rather preferred when the binder also has a certain elasticity in the hardened state.

The mineral, first particle material crushed multiple times forms an open porous frame, which results in an advantageously stabile structure of the ground covering. Due to the plurality of smaller connection or respectively adhesion zones on the individual particles, the ground covering according to the invention has advantageous properties similar to a hard court, namely a certain surface elasticity, which ensures an advantageous ball bounce. Furthermore, the binder ensures that the water absorption of the particles of the mineral first particle material is limited, which increases freeze resistance. The covering is thereby particularly durable since hardly any wear occurs on the covering.

The invention combines the advantageous properties of a hard court with those of a clay court. The covering only needs little maintenance and can be installed on any existing subsurface. Moreover, the covering enables controlled sliding, wherein a consistent ball bounce and a medium ball speed are achieved.

Due to the structure with first and second particle material, the covering is furthermore "combination elastic", which involves critical advantages with respect to pressure load and has a gentler impact on joints.

Thus, for example in the case of an adult athlete weighing approx. 70-90 kg, the coarse-grained, first particle material ensures an extensive dissipation of force during running or jumping due to the mentioned surface elasticity. In contrast, in the case of an athlete, e.g. a child weighing approx. 30-40 kg, the second particle material contained in the depot zones exerts a spot-elastic function. This ensures protection of the ligaments, tendons and joints and of the back musculature in the case of different pressure loads.

Furthermore, the covering is mainly wear-proof since very little wear occurs due to the material combination.

The second particle material can have any suitable design, wherein however the average particle size of the second particle material is less than the average particle size of the first particle material so that the second particle material can at least partially fill the depot zones resulting from the first material.

As already discussed initially, the first particle material is a mineral and is crushed multiple times. All suitable mineral substances that are available in particle form, e.g. as a granular mixture or granulate, are hereby considered. Within the framework of the present invention, "mineral" materials are all minerals, such as in particular granite, basalt, quartz and in particular clay minerals, but also processed substances, such as ceramic, ash, slag, slate chippings or threshing material.

In the same manner, the second particle material can comprise a suitable granular mixture or granulate.

According to the invention, at least the first particle material is bound with the binder. The binder can hereby be a natural and/or synthetic binder. For example, a suitable binder can comprise a cement and/or a polymer material and, in the latter case, e.g. epoxide resins and/or polyacrylates, in particular polymethacrylate. The binder is preferably weather-resistant and/or water-impermeable.

The shape of the individual particles of the first and second particle material is not restricted further. However, the first mineral particle material is a mineral material that has been doubly crushed or respectively crushed multiple times, i.e. a mineral substance that has been artificially reduced in size. This results in a mainly cubic shape of the particles, whereby the binding in the layer and the formation of sufficiently large depot zones is improved. Naturally, the first particle material can have a smaller portion of particles that have not been crushed multiple times.

Advantageously, the first particle material has high-quality, doubly crushed chippings and in particular clay granulate.

According to a preferred further development of the invention, the second particle material is also a mineral material, wherein particularly preferably the second particle material comprises quartz powder and/or burned clay. This results in even more improved durability properties of the covering.

Alternatively or additionally, the second particle material has an elastic granulate. The second particle material can hereby comprise a portion of elastic granulate, e.g. in a mixture with a mineral material. Alternatively, the second particle material can be completely designed as an elastic granulate.

The granulate can be synthetic or naturally produced. The elastic granulate is preferably made of ethylene propylene diene rubber (EPDM=ethylene propylene diene monomer) and/or styrene butadiene rubber (SBR).

The ground covering according to the invention or respectively the at least one layer can comprise first and second particle material in any mixture ratio, namely according to the desired properties, in particular with respect to elasticity and ball speed.

The layer preferably has a thickness between 15-50 mm and preferably 25 mm, i.e. the particle materials are applied in an appropriate quantity. After the application of the first particle material and before application of the second particle material, the first particle material should preferably be stripped or respectively polished with a suitable device.

Advantageously, the layer formed in this manner has a portion of gaps or respectively depot zones of 10-60% and in particular 40% by volume, which, as initially described, are at least partially filled in by the second material in the finished covering.

The quantity of the second particle material can preferably be selected so that a predominant part and in particular at least 75% and especially at least 80% of the second particle material is received in the gaps or respectively depot zones, i.e. the second particle material is applied "in excess".

The corresponding low excess of the applied second particle material remains on the surface. This permits even more improved sliding or respectively controlled braking. Due to the low excess present on the surface and the mainly unbound particles, a "chock" forms in front of the shoe of the player in the case of sudden stopping movements, which presses against the edges of the depot zones with a high pressure. An even more improved control over the movement progression is thus advantageously enabled.

According to a further development of the invention, a subset of the second material is also bound by the binder. That is, the grains or respectively particles of the subset are contained in the more or less solid composite made up of the first particle material and binder. A corresponding covering can be obtained e.g. in that the second particle material is applied during the setting time of the binder, i.e. at a time when the binder is still partially liquid and not completely set.

The present preferred embodiment of the ground covering according to the invention permits a selection of the elasticity of the covering depending on the use and desired application. In the case of the present preferred further development, the subset described above is combined with the binder and the first particle material, i.e. the individual grains or respectively particles of the subset stabilize the composite made up of the first particle material and binder. The elasticity of the covering is correspondingly reduced. The respectively bound subset can be set through corresponding selection of the setting time before application of the second particle material. The further along the setting of the binder during the application, the smaller the bound subset in the later finished covering and the higher its elasticity. The subset in relation to the second particle material is preferably between 1-10%.

As already explained initially, the first particle material and the second particle material can have all suitable embodiments, particle shapes and particle sizes as long as the average particle size of the second particle material is less than the average particle size of the first particle material.

Advantageously, the average particle size of the first particle material is between 3-20 mm, preferably between 4-10 mm and particularly preferably between 6-10 mm. The average particle size of the second particle material can be alternatively or additionally preferably between 0.1-5 mm, particularly preferably between 0.1-1.5 mm and advantageously between 0.5-1.2 mm. The use of the second particle material described above without zero portions is advantageous in particular because a corresponding covering does not require watering and can thus be used inside (e.g. in tennis centers) as well as outside year-round in all climate zones.

According to a preferred further development of the invention, the second particle material is applied in a quantity of 0.8-4 $kg/m^2$ and in particular 1.5 $kg/m^2$, which has proven to be advantageous in particular in the case of the initially named particle size.

As already discussed initially, the binder can be a natural and/or synthetic binder. According to a preferred further development of the invention, the binder has at least one water-impermeable polymer material.

Advantageously, the binder is a polyurethane binder.

The binder can hereby be made of e.g. polyurethane-forming prepolymers or can contain already (partially) prepolymerized polyurethane. The polyurethane binder has particularly preferably a (single-component) PUR diphenylmethane diisocyanate. This type of material hardens by reaction with moisture under formation of $CO_2$ into a solid, elastic and insoluble film, which is also film-like and thus water-impermeable. Accordingly, the particles of the first and, if applicable, the subset of the second particle material are mainly encased in a thin PUR film. Naturally, it is possible that the binder also comprises further components in this case, such as e.g. further polymer components and/or curing agents.

The portion of the binder in relation to the quantity of the first particle material should be selected in a suitable manner.

Advantageously, the portion of binder is between 3-13%, preferably 7%. Particularly preferably, the binder has a viscosity of approx. 8000 mPa*s to 3000 mPa*s and more preferably 4500 mPA*s depending on the temperature, in order to minimize or respectively to avoid a tempering of the binder on the individual particles at higher temperatures above 20° C.

Advantageously, the at least one previously mentioned layer of the ground covering is a play layer, i.e. the type of layer that closes the ground structure towards the top and is thus in direct contact with the players or respectively the sports equipment.

According to the invention, it thus concerns an elastic sliding covering for sports areas.

Another aspect of the present invention relates to a method for producing a ground covering for sports areas and in particular tennis courts.

According to the invention, a first particle material is hereby mixed with a binder in a first step. The particle material provided with the binder is then applied to at least one part of the sports area as long as the binder is still liquid or respectively has not hardened completely. A second particle material is then applied to at least part of the sports area. An average particle size of the second particle material is hereby less than an average particle size of the first particle material.

The aforesaid method permits the creation of a ground covering or respectively a layer according to the aforementioned aspect of the present invention, in that the first particle material is bound by the binder and forms an open porous frame so that the second particle material is arranged at least partially in the gaps or respectively "depot zones" formed by the frame.

The mentioned mixing can hereby take place using a suitable mixing device and in particular a compulsory mixer in order to obtain a homogeneous mixture of the first particle material and the binder. In the context of this explanation, a homogeneous mixture is understood in that the individual particles of the first particle material are mainly surrounded by a thin film of the binder.

The application of the first particle material mixed with the binder can take place e.g. in a sprinkled application. The first particle material is then preferably stripped or respectively polished with a suitable device, whereby the open porous frame with depot zones described above is formed.

The porosity or respectively size and number of depot zones is hereby dependent on the particle size and particle shape and on the stripping speed of the stripping procedure. Thus, in the case of an increased stripping speed, the size of the depot zones can be increased since the individual particles or respectively grains of the first particle material are hereby pulled further apart. Advantageously, the application takes place such that the applied layer has a portion of gaps or respectively depot zones of 10-60% and in particular 40% by volume, which has proven to be particularly advantageous.

In order to combine the advantages of the elastic frame created in this manner with the advantages of a clay court, the second particle material is then applied and e.g. rolled in with pressure. Alternatively or additionally, the second particle material can be pressed into the depot zones with a vibrating compactor.

It is preferred that the second particle material is applied to the first material previously provided with the binder during the setting time of the binder, i.e. the second particulate material is applied to the not yet completely hardened first particle material. A subset of the second particle material in the depot zones is hereby bound to the particles of the first particle material.

Furthermore, the above method advantageously permits the setting of the respectively desired elasticity of the ground covering through corresponding selection of the time between application of the first particle material provided with the binder and application of the second material. The longer this time span, the smaller the subset of the second particulate material that is bound with the first material, whereby the elasticity of the covering is correspondingly higher.

The setting time for conventional polyurethane binders is hereby approx. 4 hours so that the application of the second particle material and thus a setting of the elasticity are easily enabled.

The first particle material provided with the binder is preferably applied in a thickness of approx. 15-50 mm and preferably 25 mm. The second particle material is particularly preferably applied in a quantity of approximately 0.8 to 4 $kg/m^2$ and preferably 1.5 $kg/m^2$.

BRIEF DESCRIPTION OF THE DRAWINGS

The invention is described below based on exemplary embodiments. They show in.

DETAILED DESCRIPTION

Figure 1:
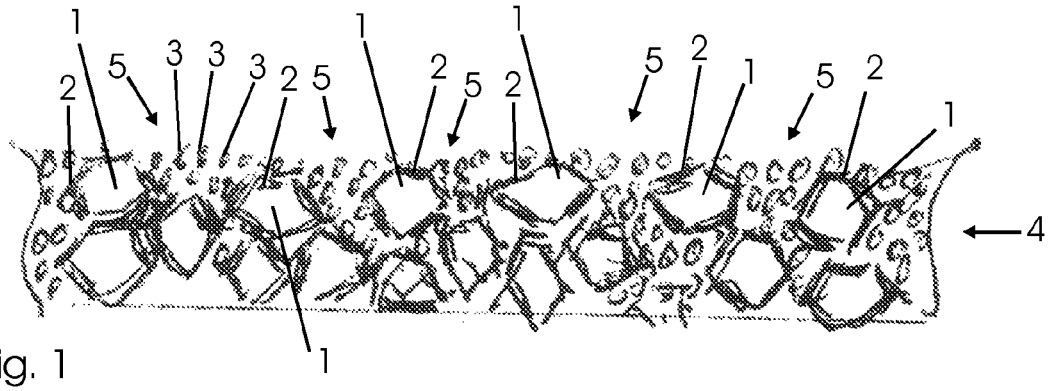
FIG. 1 a schematic sectional view through a ground covering according to the invention for sports areas according to a first exemplary embodiment.

FIG. 1 shows an elastic slide ground covering for sports areas and in particular for tennis courts according to a first exemplary embodiment in a partial, schematic sectional view.

As shown, the covering has a play layer 4, which consists of grains or respectively particles of a first mineral, doubly crushed particle material 1 as well as a second particle material 3. In order to provide a better overview, only a few of the shown grains are labeled in the figures.

As can be seen in FIG. 1, the average particle size of the second particle material 3 is considerably smaller than that of the first particle material 1. According to the present example, the particle size of the first particle material 1 is on average 8 mm and the particle size of the second particle material 3 is on average 0.75 mm.

For this reason, there are gaps or respectively "depot zones" 5 in particular in the upper area of the play layer 4 between respectively neighboring particles of the first particle material 1. Due to the fact that the first particle material 1 is doubly crushed and thus mainly contains cubic particles, particularly advantageous depot zones or respectively "anchoring zones" are created. The second particle material 3 is arranged predominantly in these depot zones 5, resulting in particularly good play properties and an improved durability of the ground covering, as explained below in relation to FIGS. 3 and 4.

The first particle material 1 consists in this case of clay material predominantly crushed multiple times, which is bound by a (single-component) binder 2, in this case PUR diphenylmethane diisocyanate. The binder 2 forms a solid, water-impermeable and film-like film by reaction with moisture on the boundary surfaces under formation of carbon dioxide.

For production, the first particle material 1 is mixed homogeneously with a compulsory mixer such that each individual rock particle or respectively each particle of the first particle material 1 is entirely enclosed in a thin film of binder 2, such as for example indicated in FIG. 1. In order to avoid a tempering of the binder 2 at temperatures greater than 20° C., the binder 2 has a viscosity of approx. 4500 mPa*s. The portion of the PU binder 2 in relation to the first particle material 1 is 7%.

Figure 2:
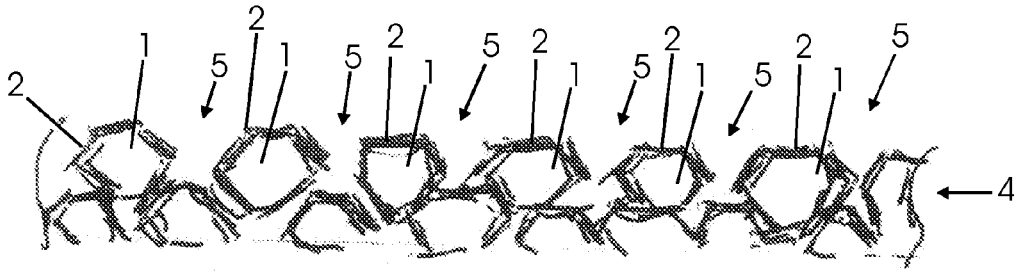
FIG. 2 a sectional view according to the exemplary embodiment from FIG. 1 before application of a second particle material.

The homogeneous mixture of the first particle material 1 and binder 2 obtained in this manner is applied to an existing subsurface (not shown) in a thickness of 25 mm and is stripped and polished with a suitable device. The layer formed in this manner is shown schematically in FIG. 2.

As can be seen in the figure, an open porous and elastic granular structure provided with depot zones 5 is given, the porosity or respectively size and number of depot zones 5 of which depend directly on the particle size and particle shape as well as on the stripping speed of the stripping movement.

In the case of an increase in the horizontal stripping speed, the individual particles of the first particle material 1 encased in binder 2 are pulled further apart than for example in the case of a slow stripping movement. The created granular structure has in this case a 40% share of depot zones by volume, i.e. it consists of 60% rock particles or respectively particles and 40% depot zones, which are filled with the second particle material 2 in the finished layer 1.

Since, in this case, each individual particle of the particle material 1 is encased in an elastic and water-impermeable plastic film, water absorption cannot take place since the granular structure has no capillary function. Furthermore, a large pore percentage is given and furthermore a plurality of smaller connection and adhesion zones are given through the crushed shaped so that the applied particle material 1 cannot freeze up. However, a certain elasticity or respectively surface elasticity is given. Moreover, the layer 4 has a permanently high water permeability.

The granular structure formed in this manner already has important positive characteristics of a hard court, such as e.g. consistent ball bounce, low maintenance and no need for watering.

In order to combine the above advantages with those of a clay court, the second particle material 3, which consists here of an elastic-synthetic granulate made of styrene butadiene rubber (SBR), is applied during the setting time of the binder 2, i.e. within 4 hours. This is applied, distributed and/or rolled in with pressure to the granular structure with a small excess. Alternatively, it can be pressed into the depot zones with a vibrating compactor. As already mentioned, the finished covering with play layer 4 is shown in FIG. 1.

As shown there, a small excess of approx. 20% of the second particle material 3 remains on the surface, while approx. 80% is pressed into the depot zones. Of this 80% of the second particle material 3, a subset of approx. 5% is joined, i.e. combined together, with the first particle material 1 through the not yet completely hardened binder 2.

Since the second particle material 3 is rolled or respectively pressed into the depot zones 5 under pressure, it returns in an increased manner to the surface after the rolling procedure due to the elasticity of the individual particles in the area of the depot zones 5. If pressure is now exerted on the layer 4, the elastic granulate particles of the second particle material 3 press together so that an elastic effect is achieved.

Figure 3:
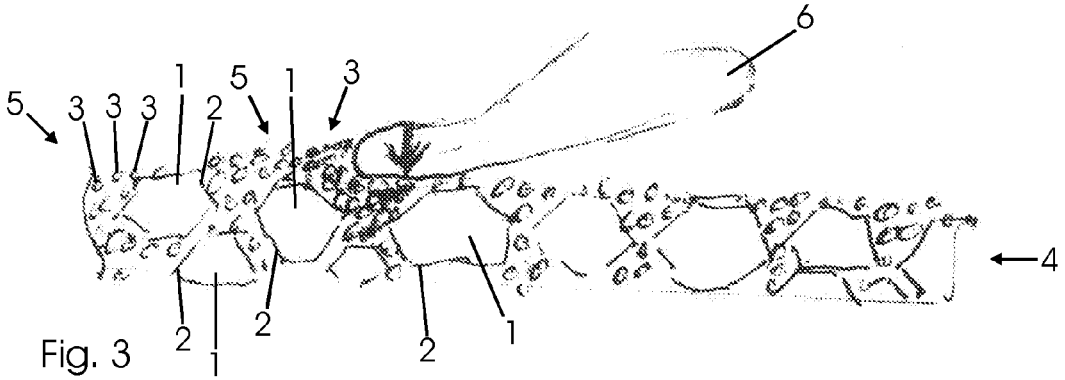
FIG. 3 the exemplary embodiment according to FIG. 1 in the case of a stopping movement of an athlete as well as FIG. 4 the exemplary embodiment according to FIG. 1 in the case of sliding movement of an athlete.
Figure 4:
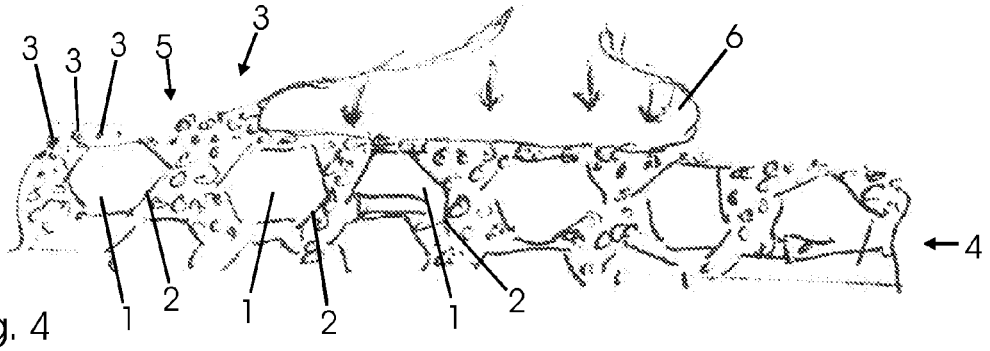

The depot zones 5 simultaneously effectuate a controlled braking depending on the placement of the foot of the player. FIG. 3 shows the exemplary embodiment according to FIG. 1 in the case of a stopping movement of a player. The shoe 6 of the player is shown here in the case of a sudden braking. As can be seen in FIG. 3, a fairly large "chock," which presses against the edges of the depot zones 5 with a high pressure, is formed by the aforementioned excess of the second particle material 3 and thus a controlled braking is supported. A sliding movement of the shoe 6, as shown in FIG. 4, is simultaneously supported in that only a low surface pressure is given here and the existing excess ensures a controlled sliding.

Since high propulsive forces occur on the first particle material 1, particularly in the uppermost rock layer, caused by the high vertical propulsive forces during braking or respectively sliding, the depot zones 5 serve as an additional anchor for the individual coarse particles against vertical displacement or respectively breakaway additionally due to the high quantity of pressed-in second particle material 3, since the second particle material 3 introduced into the depot zones 5 has approx. 1.5 times the volume of a particle of the first particle material 1.

The elastic slide ground covering with play layer 4 provided in this manner thus combines the advantages of a hard court with those of a clay court. In particular, the covering requires no watering and can thus be installed on any existing subsurface inside (e.g. in tennis centers) as well as outside year-round in all climate zones with little maintenance. The invention was explained above based on exemplary embodiments. However, the invention is not limited to the above embodiments. In particular, the explained exemplary embodiments permit numerous changes or updates. For example, it is conceivable that

- the first particle material 1 has, alternatively or in addition to a clay material, granite, basalt, quartz or slate chippings,
- the second particle material 3 is a mineral,
- the second particle material 3 comprises,
- alternatively or
- additionally, an elastic granulate made of ethylene propylene diene rubber (EPDM=ethylene propylene diene monomer) and/or
- the application of the second particle material 3 only takes place after complete hardening of the binder 2.

The invention claimed is:

1. A ground covering for sports areas, in particular tennis courts, at least having one layer (4) with
- a first mineral particle material (1),
- a second particle material (3) as well as
- a binder (2), wherein
- an average particle size of the second material (3) is less than an average particle size of the first material (1),
- the first material (1) is bound by the binder (2) and
- the second material (3) is arranged at least partially in depot zones (5) formed by the first particle material (1), wherein the second particle material (3) comprises an elastic granulate, and wherein a subset of the second particle material (3) is bound by the binder (2).

2. The ground covering according to claim 1, wherein the first particle material (1) is a crushed mineral particle material (1).

3. The ground covering according to claim 1, wherein the average particle size of the second particle material (3) is between 0.1-5 mm.

4. The ground covering according to claim 3, wherein the average particle size of the second particle material (3) is 0.1-1.5 mm.

5. The ground covering according to claim 1, wherein the binder (2) comprises at least one water-impermeable polymer.

6. The ground covering according to claim 1, wherein the binder (2) is a polyurethane binder.

7. The ground covering according to claim 1, wherein the elastic granulate is selected from the group consisting of ethylene propylene diene rubber and styrene butadiene rubber and a mixture of ethylene propylene diene rubber and styrene butadiene rubber.

8. The ground covering according to claim 1, wherein a predominant part of the second particle material (3) is included in the depot zones (5).

9. The ground covering according to claim 1, wherein the layer (4) is a play layer.

* * * * *